US005508976A

United States Patent [19]

Pauer

[11] Patent Number: 5,508,976

[45] Date of Patent: Apr. 16, 1996

[54] LOW FREQUENCY UNDERWATER ACOUSTIC TRANSDUCER

[75] Inventor: Lyle A. Pauer, Brecksville, Ohio

[73] Assignee: Loral Defense Systems, Akron, Ohio

[21] Appl. No.: 348,433

[22] Filed: Dec. 2, 1994

[51] Int. Cl.[6] ..... H04R 17/00

[52] U.S. Cl. ..... 367/159; 367/163; 367/174; 310/337

[58] Field of Search ..... 367/159, 163, 367/174; 310/337

[56] References Cited

U.S. PATENT DOCUMENTS

| | | | |
|---|---|---|---|
| 4,380,808 | 4/1983 | Hill et al. | 367/153 |
| 4,845,688 | 7/1989 | Butler | 367/174 |
| 4,894,811 | 1/1990 | Porzio | 367/174 |
| 4,916,675 | 4/1990 | Hoering | 367/153 |
| 5,136,556 | 8/1992 | Obara | 367/163 |
| 5,355,351 | 10/1994 | Yoshikawa et al. | 367/156 |

*Primary Examiner*—Stephen C. Bently
*Assistant Examiner*—Christopher K. Montgomery
*Attorney, Agent, or Firm*—Renner, Kenner, Greive, Bobak, Taylor & Weber

[57] ABSTRACT

An underwater acoustic transducer for providing high amplitude low frequency acoustic output wherein a plurality of flextensional transducer ovals are formed into a mechanical transformer ring with a corresponding plurality of transducer drivers received therein. A corresponding plurality of radiating surface plates are fixed to the flextensional transducer ovals so as to form a flextensional ring which has disposed on both ends thereof an end plate. Furthermore, a sealing boot is disposed around the flextensional ring which receives the necessary power to operate the transducer drivers so as to vibrate the flextensional transducer ovals to provide the desired motion. Additionally, the flextensional rings can be configured into a tube so as to provide increased levels of acoustic energy.

17 Claims, 4 Drawing Sheets

LOW FREQUENCY UNDERWATER ACOUSTIC TRANSDUCER

TECHNICAL FIELD

The invention herein resides in the art of underwater acoustic transducers for use in a variety of applications including but not limited to training targets, sonars and deception devices. More particularly, the invention relates to an underwater acoustic transducer which incorporates a plurality of electro-mechanical spring apparatuses, which are based on flextensional transducer techniques configured in a ring. Specifically, the present invention relates to an underwater acoustic transducer which has a plurality of flextensional transducer rings concentrically aligned so as to generate low frequency acoustic energy with high acoustic output.

BACKGROUND ART

It is well known in the art of acoustics that electrical energy may be converted into acoustic energy and vice versa by the use of transducers. Two commonly known transducers are an electrodynamic transducer and a piezoelectric transducer. In electrodynamic transducers, an alternating electric current passes through a coil so as to interact with a steady radial magnetic flux causing the coil to vibrate. Accordingly, the coil drives a diaphragm which radiates sound waves from one side when an opposite side is enclosed. This transduction process is reversible when sound waves strike the diaphragm to set up a periodic variation of air pressure adjacent to the diaphragm causing it to vibrate. As the moving coil disturbs the magnetic flux, an electromagnetic field is generated which causes a current to flow when a load is connected to the coil terminals. A transducer is also created when electrical energy is applied to materials that have piezoelectric properties such as ceramic or quartz. As is well known, piezoelectric materials expand when electrical energy is applied thereto. Likewise, the piezoelectric material contracts when the electrical energy is removed. As such, if a rapidly alternating electric current is applied to the piezoelectric material, it expands and contracts accordingly. Therefore, the piezoelectric materials respond with a vigorous resonant vibration.

The aforementioned electrodynamic and piezoelectric transducers are used to produce intense underwater acoustic signals. However, these transducers have several shortcomings. For example, the magnetic circuit and wire coil of the electrodynamic transducer is inefficient in converting electrical energy to acoustic energy. The piezoelectric materials are quite stiff such that a large mass is required to attain a transducer which resonates at low frequencies. Other methods of providing low frequency resonators do not have the structural integrity to withstand the environmental surroundings in which they must operate.

To surmount the short-comings of piezoelectric transducers it is known to use flexural bars or plates attached to ceramic piezoelectric materials such that when the ceramic material expands from an applied current, the flexural bars or plates are driven into a low frequency bending mode. A low resonant frequency is obtained by interconnecting multiple bars or plates together in a mechanical series to increase the displacement thereof. Unfortunately, this type of transducer is limited because ceramic piezoelectric material is weak in tension. One proposed solution for overcoming this weakness is by inserting the ceramic piezoelectric material within a spring which amplifies the motion of the material.

Furthermore, these springs are combinable either in series to obtain greater displacement or in parallel to obtain a greater force. However, this proposed solution still does not have an especially large surface area to provide a high amplitude low frequency underwater acoustic transducer.

Another proposed solution is to construct an underwater acoustic projector composed of individual ceramic plates configured in a ring. The ceramic plates in the ring are electrically connected in parallel such that when an alternating voltage is applied to the ceramic plates, a radially alternating ring displacement results in acoustic radiation. Large radial displacements are required to radiate low frequency acoustic energy. One drawback of this proposed solution is that piezoelectric ceramic materials are limited in the voltage amplitude that can be applied thereto. Thus, for an underwater acoustic projector of a given size, the maximum acoustic energy that can be radiated is limited by the properties of the piezoelectric ceramics used. As discussed earlier, since the piezoelectric ceramic material is quite stiff, the low frequency ceramic ring transducers must have a large diameter to achieve a low frequency resonance.

It is clear that there is a need in the art for an efficient, high amplitude low frequency acoustic transducer. Furthermore, there is a need in the art for such a high amplitude low frequency acoustic transducer that maximizes the expansion and contraction of ceramic piezoelectric materials, while reducing the amount of tension applied to such materials to achieve the desired result.

DISCLOSURE OF INVENTION

In light of the foregoing, it is a first aspect of the present invention to provide an underwater acoustic transducer that radiates low frequency, high amplitude acoustic energy.

Another aspect of the present invention is to provide an underwater acoustic transducer that radiates low frequency, high amplitude acoustic energy.

Still a further aspect of the present invention is to provide an underwater acoustic transducer that radiates acoustic energy by providing a plurality of flextensional transducers configured in a flextensional ring.

An additional aspect of the present invention is to provide an underwater acoustic transducer which radiates acoustic energy from a plurality of flextensional rings stacked upon one another so as to form a flextensional tube.

Yet an additional aspect of the present invention is to provide a tubular underwater acoustic transducer enclosed and sealed within a flexible boot such that the flextensional tube can be filled with an appropriate gas to withstand the external pressures exposed thereto during deep water operation.

A further aspect of the present invention is to provide a tubular underwater acoustic transducer which contains all the necessary electronics to control and operate the plurality of flextensional transducers.

Yet another aspect of the present invention is to provide an underwater acoustic transducer which has a reduced weight when compared to solid ceramic ring transducers.

Still another aspect of the present invention is to provide an underwater acoustic transducer which has a plurality of flextensional transducers configured in a flextensional ring so as to provide a longer operating life than previously known transducers.

Yet an additional aspect of the present invention is to provide an underwater acoustic transducer made up of a plurality of flextensional transducers configured in a flextensional ring that is more efficient than previously known electrodynamic projector transducers.

A further aspect of the present invention is to provide an underwater acoustic transducer configured in a flextensional ring to allow easier application of a pre-stress to the flextensional ring than compared to applying pre-stress to a solid ceramic ring transducer.

The foregoing and other aspects of the invention which shall become apparent as the detailed description proceeds, are achieved by an acoustic transducer for providing high amplitude, low frequency acoustic energy comprising: a plurality of flextensional transducer ovals in communication with one another so as to form a mechanical transformer ring; a corresponding plurality of transducer drivers received within said flextensional transducer ovals; a corresponding plurality of radiating surface plates affixed to said flextensional transducer ovals so as to form a flextensional ring, said flextensional ring having disposed on both ends thereof an end plate; a sealing boot disposed around said flextensional ring; and means for selectively supplying power to said plurality of transducer drivers so as to vibrate said flextensional transducer ovals to provide a desired acoustic energy.

The present invention also provides an acoustic transducer for providing high amplitude, low frequency resonance, comprising: means for receiving a plurality of transducer drivers in an annular configuration; means for selectively supplying power to said plurality of transducer drivers so that they reciprocatingly expand and contract; and means for transforming the reciprocating motion of said transducer drivers into the desired acoustic energy.

BEST MODE FOR CARRYING OUT THE INVENTION

Figure 1:
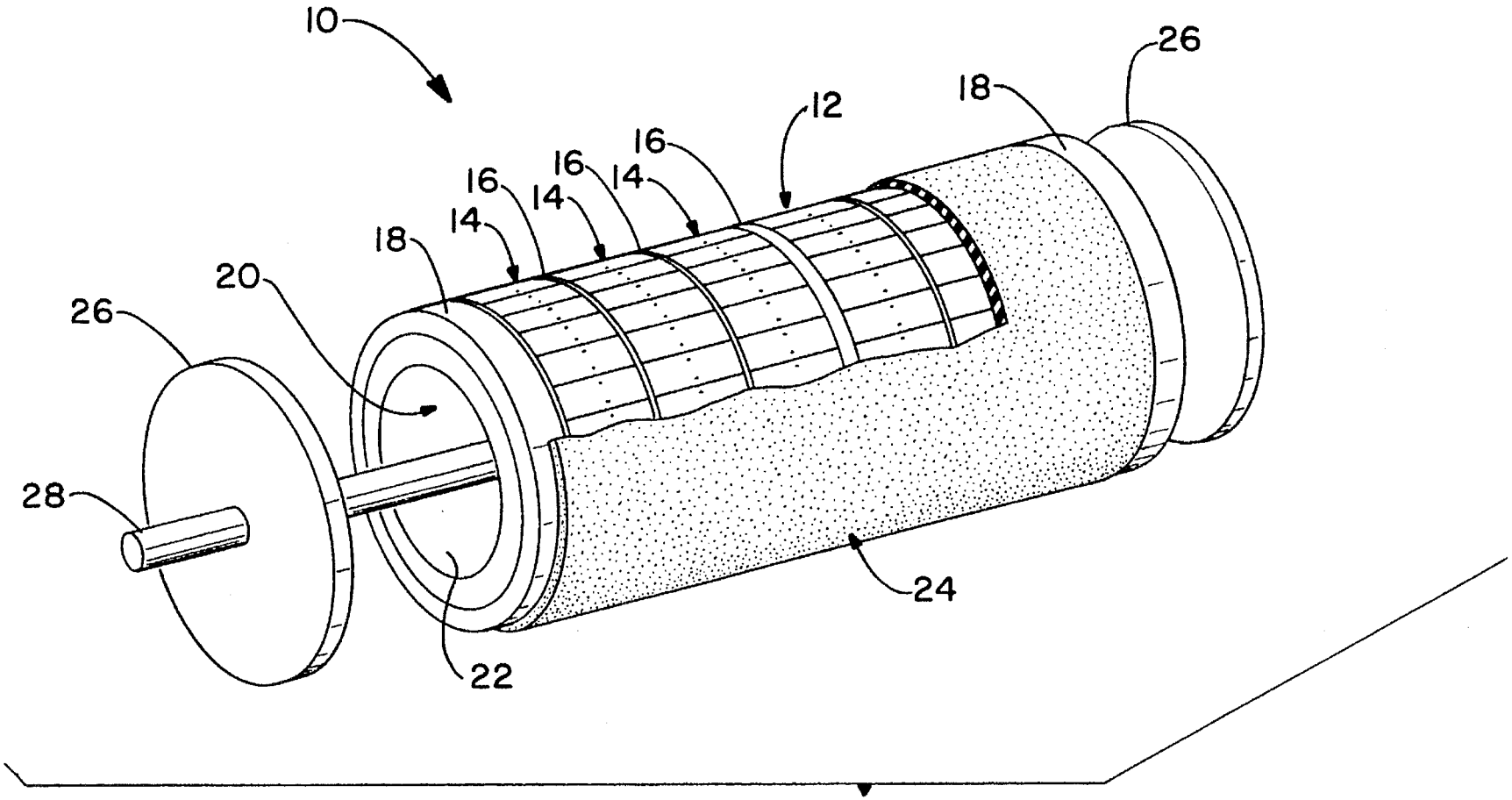
FIG. 1 is a perspective view of an underwater acoustic transducer partially in section, with a flexible boot enclosure.

Referring now to the drawings and more particularly to FIG. 1, it can be seen that an underwater acoustic transducer according to the present invention is designated generally by the numeral 10. The acoustic transducer 10 is made up of a flextensional tube 12 which has a plurality of flextensional rings 14 interleaved with a like number of interconnecting bands 16. It will be appreciated that the transducer 10 could be configured with only one flextensional ring 14, thus eliminating the need for the interconnecting bands 16. The flextensional tube 12 is terminated at each end by an end flange 18 so as to form a tube aperture 20 that has an interior surface 22. Completely enclosing the flextensional tube 12 is a flexible boot 24 which interfaces with a fluid medium while preventing the fluid medium from entering the flextensional tube. End plates 26 are secured to the end flanges 18 of the tube aperture 20 in a manner well known in the art. In the preferred embodiment, the end flanges 18 are made of aluminum, although any material with similar properties can be employed. The flexible boot 24 is made of a rubber material, although any material with similar properties may be employed. An electrical cable 28 may be directed through the end plate 26 to supply the necessary control signals and power to operate the underwater acoustic transducer 10.

Figure 2:
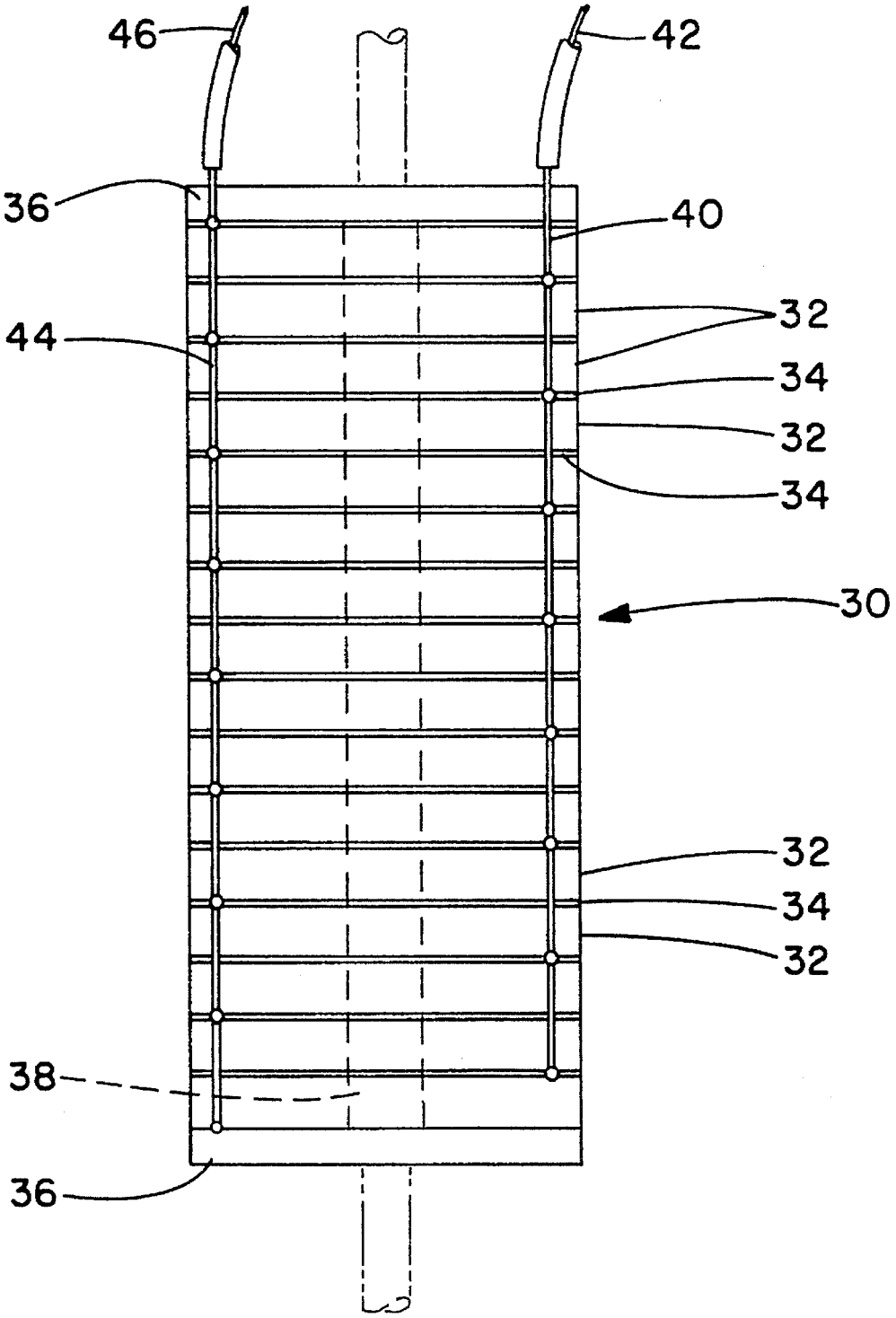
FIG. 2 is a side elevational view showing a piezoelectric ceramic stack used as a flextensional transducer according to the present invention.

Referring now to FIG. 2, it can be seen that a transducer driver stack 30 is shown. The transducer driver stack 30 includes a plurality of piezoelectric ceramic plates 32, each of which has a positive side and a negative side. Interleaved between the plurality of piezoelectric ceramic plates 32 are electrodes 34 that provide electrical contact thereto. At the opposed ends of the driver stack 30 is an insulator 36. It should be appreciated that the driver stack 30, the ceramic plates 32, the electrodes 34, and the insulators 36 have a concentric aperture 38 proceeding therethrough. Electrically connected to the electrodes 34 on the positive side of the piezoelectric ceramic plates 32 is a bus wire 40 which receives electrical power from a positive wire 42. In a similar fashion, the negative sides of the piezoelectric ceramic plates 32 are collectively interconnected to the electrodes 34 by a bus wire 44 which is connected to a negative wire 46.

Figure 3:
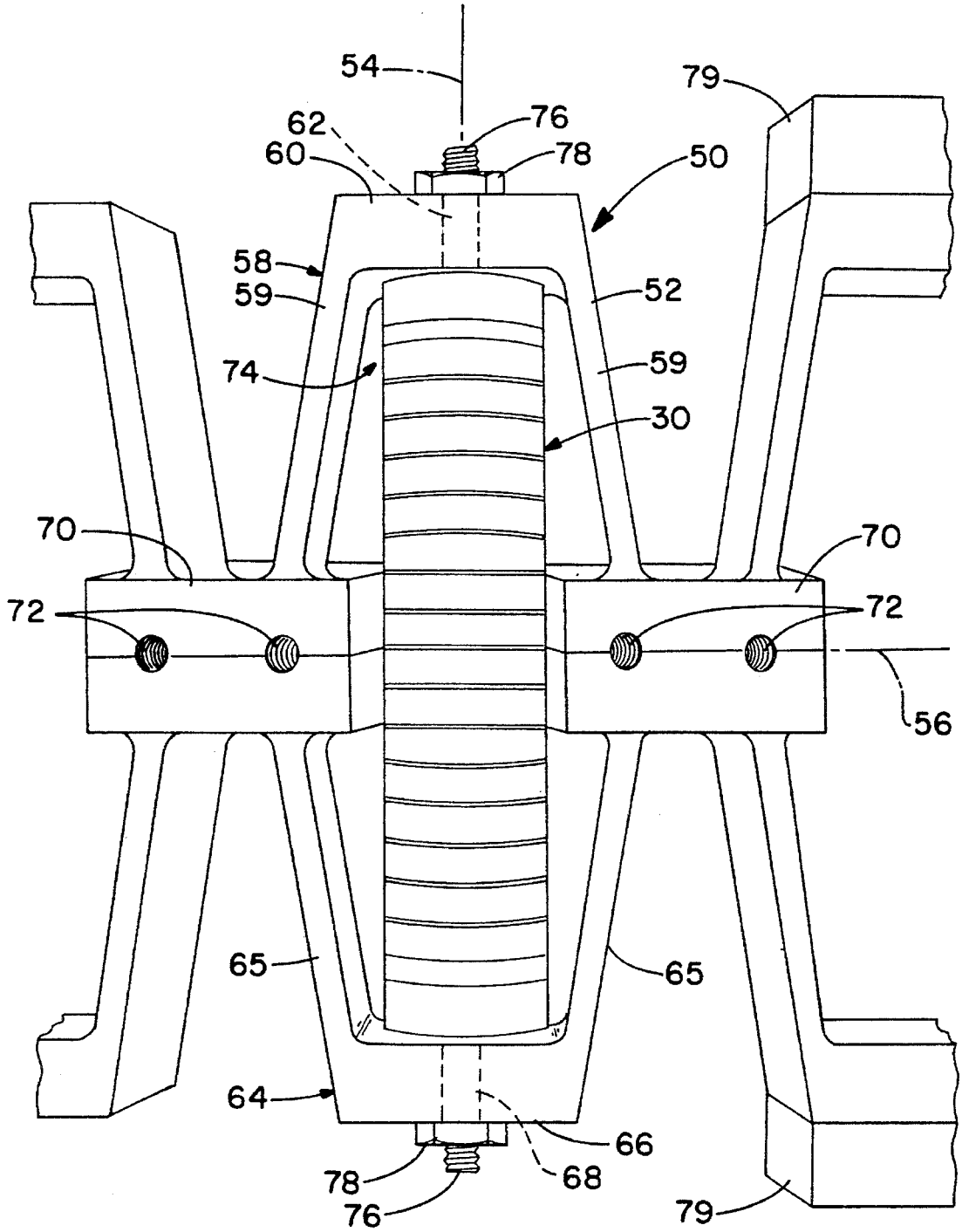
FIG. 3 is a side elevational view showing a flextensional ring with an exemplary piezoelectric stack and a prestress imparted thereon.

Referring now to FIG. 3, it can be seen that a mechanical transformer ring 50 receives a plurality of transducer driver stacks 30. In particular, the mechanical transformer ring 50 is made up of a plurality of flextensional transducer ovals 52, each of which receives a transducer driver stack 30. It will be appreciated that the flextensional transducer oval 52 has a major axis 54 and a minor axis 56 which are mutually perpendicular. Aligned with the major axis 54 are a pair of opposed sections 58 and 64. The section 58 consists of a pair of extended legs 59 integrally between a mount 60 which has mounting hole 62. In a similar manner, the section 64 has a pair of extended legs 65 integrally between a mount 66 which has a mounting hole 68. Disposed along the minor axis 56 is a pair of interconnecting ribs 70 which integrally interconnects section 58 to section 64. Furthermore, the interconnecting ribs 70 also function to integrally interconnect the flextensional transducer ovals 52 to one another so as to form the mechanical transformer ring 50. For purposes to be discussed later, the interconnecting ribs 70 extend radially outwardly from the flextensional transducer ovals 52. It will be appreciated that the interconnecting ribs 70 have a pair of internally threaded plate holes 72. Therefore, it can be seen that the section 58, the section 64, and the interconnecting ribs 70 form a stack cavity 74 to individually receive a transducer driver stack 30. In the preferred embodiment, the mechanical transformer ring 52 is made of aluminum, although any rigid metal or polymeric material could be used.

Those skilled in the art will appreciate that the aperture 38 of the transducer driver stack 30 is concentrically aligned with the mounting holes 62 and 68 so as to receive a pre-stress bolt 76 which is secured thereto by a pair of nuts 78 disposed at each end of the bolt. Of course, other methods of securing the prestress bolt 76 to the transducer oval 52 may be employed. Where the mounts 60, 66 are adjacent the end flanges 18, insulator pads 79 are disposed therebetween. Where the flextensional rings 14 are stacked, insulator pads 79 are disposed between the mounts 60, 66 and the interconnecting bands 16. Of course, the insulator pads 79 have a clearance hole for access to the nuts 78. The insulator pads 79 are made of a rubber material, although any material with similar properties may be employed.

Figure 4:
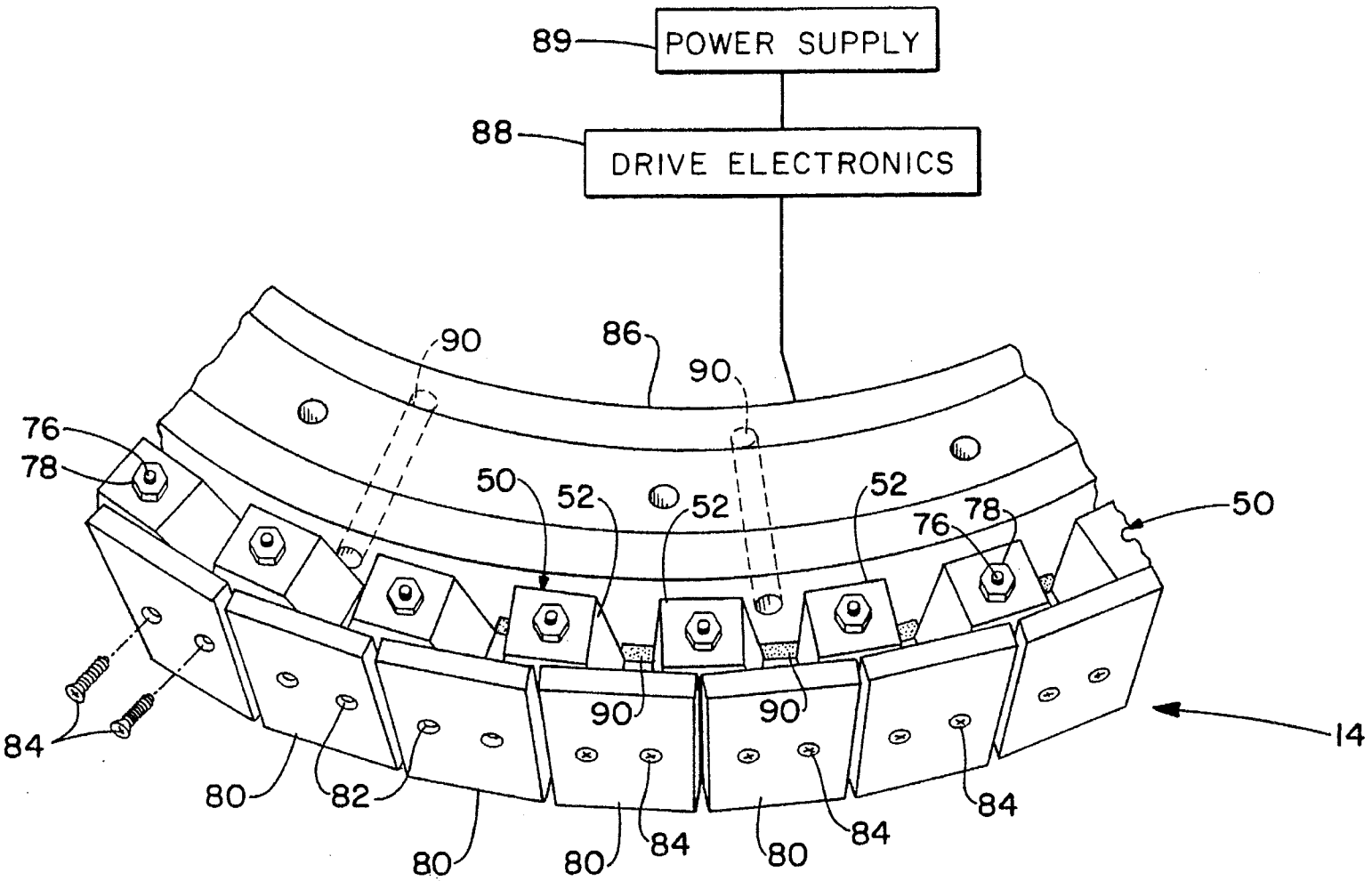
FIG. 4 is a top perspective view of a flextensional ring according to the present invention with a plurality of exemplary radiating surface plates disposed thereon and an interior ring disposed therein.

Referring now to FIG. 4, it can be seen that a plurality of radiating surface plates 80, which have a pair of mounting holes 82, are fastenably secured to the interconnecting ribs 70 by a pair mounting screws 84 so as to form the flextensional ring 14. Since the diameter of the interconnecting ribs 70 is slightly larger than the diameter of the flextensional transducer ovals 52, there is a clearance between the mounted radiating surface plates 80 and the flextensional transducer ovals 52. It will be further be appreciated that there is a clearance or gap between the mounted radiating surface plates 80. Received within the mechanical transformer ring 50 is an interior ring or tube 86 which receives drive electronics 88 and a power supply 89 to electrically operate the transducer driver stacks 30. The interior ring or tube 86 also functions to provide structural support to the mechanical transformer ring 52 with insulator pads 90 disposed therebetween. If required, the acoustic transducer 10 is filled with a gas, such as nitrogen, to provide pressure equalization for when the acoustic transducer 10 is subjected to extreme external pressure in deep water. To assist in the pressure equalization, a plurality of breather tubes 90 are transversely directed through the interior ring or tube 86 to allow maximum contraction and expansion of the flextensional ring 14.

Therefore, in actual operation, the plurality of piezoelectric ceramic plates 32 receive an electrical power supply by the positive wire 42. As is well known in the art, the piezoelectric ceramic plates 32 expand in response to an applied voltage or current and decrease when the voltage or current is removed. As such, since the ceramic plates 32 are electrically connected in parallel, the overall length of the transducer driver stack 30 expands and contracts between predetermined lengths. Therefore, when the transducer driver stack 30 expands and contracts along the major axis 54 of the flextensional transducer oval 52, a corresponding vibration along the minor axis 56 results. As best seen in FIG. 3, it is apparent that the minor axis 56 extends the entire circumference of the mechanical transformer ring 50 such that the entire diameter of the mechanical transformer ring 50 vibrates as an alternating voltage or current is applied to the transducer driver stacks 30.

As best seen in FIG. 3, a mechanical pre-stress is applied to the individual flextensional transducer ovals 52. The mechanical pre-stress is attained by inserting a pre-stress bolt 76 through the aperture 38 of the transducer driver stacks 30 and the mounting holes 62, 68 and then compressing the flextensional transducer oval 52 by securably fastening nuts 78 to the bolt. Those skilled in the art will appreciate that a mechanical pre-stress is necessary when operating piezoelectric ceramics at high drive levels, because piezoelectric ceramics are inherently weak in tension. The above-described method of applying a mechanical pre-stress to a flextensional transducer results in a time savings as compared to the method of applying a mechanical pre-stress to a ceramic ring transducer. The normal method of applying mechanical bias to a ceramic ring involves wrapping the ceramic ring exterior with a fiber such as fiberglass, and then coating the ring with an uncured epoxy while the fiber is applied in tension. When the epoxy cures, a mechanical bias is permanently maintained in the ceramic ring. This prior art wrapping operation is a time consuming transducer assembly step.

A further advantage of the present invention is apparent from the construction of the mechanical transformer ring 50. The mechanical transformer ring 50 is fabricated as a one piece construction which is in distinct contrast to a method in which many flextensional oval components are glued or fastenably secured together to form the flextensional ring. It is well known that gluing or fastenably securing flextensional oval components to one another results in higher mechanical loss. As such, tolerance build-up problems inherent in an assembly of many components are avoided, resulting in a more uniform structure with a more precisely controlled diameter that provides a predictable resonance.

The interior ring 86, which fits within the interior of the transformer ring 50, is employed to provide structural support thereto. Moreover, the interior ring 86 contains the necessary drive electronics 88 and power supply 89 for expanding and contracting the piezoelectric ceramic plates 32. It should be appreciated, however, that the electrical power supplied to the piezoelectric ceramic plates 32 may be supplied through an electrical cable 20 which has a watertight interconnection through the end plate 26, as seen in FIG. 1. Additionally, the flextensional rings 14 are interleaved with the interconnecting bands 16 so as to form the flextensional tube 12.

In order to provide a reliable underwater acoustic projector 10, the flexible boot 24 is disposed around the flextensional tube 12. The flexible boot 24 functions to cover the gaps between the radiating surface plates 80 and between the edges of the plates and the interconnecting bands 16. The flexible boot 24 is bonded to the flextensional tube 12 by any commercially available contact type adhesive to ensure watertight integrity while also providing a predictable surface that interfaces with the fluid medium. Therefore, as the flextensional tube 12 expands and contracts from the applied alternating current, the flexible boot 24 provides a uniform surface from which emanates the desired high amplitude low frequency acoustic energy. Those skilled in the art will appreciate that the clearances or gaps between the plates 80 themselves and between the plates 80 and the transducer ovals 52 allow the flextensional ring 14 to expand and contract with maximum efficiency. In the preferred embodiment, the flextensional tube 12 is utilized for emitting acoustic signals which are used to imitate underwater targets, to determine the temperature of surrounding medium, or to function as diversionary decoys for submarines.

It should be apparent from the above description that the acoustic transducer 10 has several advantages over tinderwater acoustic transducers that are composed of individual ceramic plates. Primarily, the acoustic transducer 10 has less weight compared to a solid ceramic ring because the proportion of the piezoelectric ceramic material required to generate a comparable signal is much less. Additionally, the transducer 10 provides a longer operating life as compared to other flexural transducer types because analysis shows that alternating stresses within the mechanical transformer ring 50 are relatively low even under high output drive conditions. Furthermore, the piezoelectric ceramic driver 30 is more efficient than an electrodynamic transducer because the piezoelectric ceramic materials do not require the same amount of electricity required to drive the magnetic circuit and wire coil driver in an electrodynamic transducer.

Thus, it can be seen that the objects of the invention have been satisfied by the structure presented above. It should be apparent to those skilled in the art that the objects of the present invention could be practiced with any size mechanical transformer ring and with any length flextensional tube.

While the preferred embodiment of the invention has been presented and described in detail, it should be understood that the invention is not limited thereto or thereby. Indeed, various materials and configurations may be used in the construction of the invention to meet the various needs of the end user. Accordingly, for an appreciation of the true scope and breadth of the invention, reference should be made to the following claims.

What is claimed is:

1. An acoustic transducer for providing high amplitude low frequency acoustic energy, comprising:

a plurality of flextensional transducer ovals having ribs to integrally interconnet said flextensional transducer ovals to form a mechanical transformer ring, said ribs having mounting holes;

a corresponding plurality of transducer drivers received within said flextensional transducer ovals;

a corresponding plurality of radiating surface plates affixed to said mounting holes to form a flextensional ring, said flextensional ring having disposed on both ends thereof an end plate;

a sealing boot disposed around said flextensional ring; and means for selectively supplying power to said plurality of transducer drivers so as to vibrate said flextensional ring to direct acoustic energy outwardly therefrom.

2. An acoustic transducer according to claim 1, wherein a flextensional tube is formed by joining together a plurality of said flextensional rings, said flextensional tube having an aperture, said sealing boot extending the entire length of said flextensional tube with said end plates disposed at both ends so as to create a watertight seal around said flextensional tube.

3. An acoustic transducer according to claim 2, wherein said flextensional transducer oval comprises:

mutually perpendicular first and second oval axes;

a first section having a pair of first legs extending from a first mount; and a second section having a pair of second legs extending from a second mount wherein said ribs interconnect said first legs to their corresponding second legs so as to form a driver stack cavity, said ribs being disposed along said first oval axis and said first and second mounts being disposed along said second oval axis.

4. An acoustic transducer according to claim 3, wherein said transducer drivers comprise:

a plurality of sequentially arranged piezoelectric elements with opposed ends having an aperture therethrough;

means for receiving electrical power so as to actuate said piezoelectric elements; and insulators disposed on each of said opposed ends.

5. An acoustic transducer according to claim 4, wherein said first and second mounts have corresponding mounting holes concentric with said second oval axis, said mounting holes and said transducer driver aperture receiving a prestress bolt which is secured to said first and second mounts by corresponding nuts so as to bias said transducer drivers.

6. An acoustic transducer according to claim 5, wherein said flextensional tube has disposed therein a pressurized gas substantially equivalent to the external pressure subjected to said flextensional tube.

7. An acoustic transducer according to claim 6, wherein said mechnical transformer ring is made of aluminum.

8. An acoustic transducer according to claim 7, wherein said sealing boot is made of rubber.

9. An acoustic transducer for providing high amplitude low frequency acoustic energy, comprising:

a plurality of flextensional transducer ovals receiving a like plurality of transducer drivers, said flextensional transducer ovals integrally interconnected to form a mechanical transformer ring, wherein said mechanical transformer ring has a plurality of radiating surface plates secured thereto: and means for selectively supplying power to said plurality of transducer drivers to reciprocatingly expand and contract each of said plurality of transducer drivers Within each respective said flextensional transducer oval, wherein said plurality of radiating surfaces plates transform the reciprocating motion of said transducer drivers into outwardly directed vibrating motion of said mechanical transformer ring to generate acoustic energy.

10. An acoustic transducer according to claim 9, wherein said transducer drivers comprise:

a plurality of sequentially arranged piezoelectric ceramic elements with opposed ends having an aperture therethrough and insulators disposed on each end thereof; and means for individually directing said power supply means to said piezoelectric ceramic elements.

11. An acoustic transducer according to claim 10, wherein each said flextensional transducer oval comprises:

a first section having a first pair of legs extending from a first mount;

a second section having a second pair of legs extending from a second mount; and a pair of ribs, each of which individually interconnects a first extended leg to a corresponding second extended leg so as to receive one of said transducer drivers within said first section and said second section, wherein each of said ribs abuts an adjacent flextensional transducer oval.

12. An acoustic transducer according to claim 11, wherein a plurality of said mechanical transformer rings are concentrically aligned with one another so as to form a flextensional tube having an aperture therethrough which is enclosed at each end by an end plate.

13. An acoustic transducer according to claim 12, wherein said flextensional tube has disposed thereon a flexible boot bonded to said end plates so as to provide a water tight seal thereto.

14. An acoustic transducer according to claim 13, wherein said flextensional tube has received within said tube aperture a pressurized gas substantially equivalent to the external pressure of said flextensional tube.

15. An acoustic transducer according to claim 14, wherein said power supply means is received within said flextensional tube.

16. An acoustic transducer, comprising:

a plurality of flextensional transducer ovals having mutually perpendicular first and second axes;

a plurality of ribs integrally interconnecting said plurality of flextensional transducer ovals along one of the first and second axes to form a mechanical transformer;

a plurality of transducer drivers, wherein each of said plurality of flextensional transducer ovals receives one or said plurality of transducer drivers, said transducer drivers expanding and contracting along one of the first and second axes, the remaining of the first and second axes contracting and expanding in a corresponding manner; and a plurality of radiating surface plates secured to said mechanical transformer, wherein said plurality of radiating surface plates vibrate outwardly from the remaining of the first and second axes.

17. The acoustic transducer according to claim 16, further comprising:

a power supply for expanding and contracting said transducer drivers;

a plurality of interconnecting bands to interconnect a plurality of said mechanical transformers to form a flextensional tube; and a sealing boot disposed around said flextensional tube, wherein said flextensional tube has disposed therein a pressurized gas having a pressure substantially equivalent to the external pressure subjected to said flextensional tube.

* * * * *